US005830016A

United States Patent [19]

Chuang

[11] Patent Number: 5,830,016

[45] Date of Patent: Nov. 3, 1998

[54] INTERFERENCE-PROOF DEVICE FOR ELECTRIC CONNECTOR

[76] Inventor: Johnson Chuang, 2F, No. 85, Lane 59, Chung-chen Rd., Lou-Chow Hsiang, Taipei Hsien, Taiwan

[21] Appl. No.: 790,405

[22] Filed: Jan. 29, 1997

[51] Int. Cl.[6] ..... H01R 13/66

[52] U.S. Cl. ..... 439/620

[58] Field of Search ..... 439/620, 333

[56] References Cited

U.S. PATENT DOCUMENTS 5,158,482 10/1992 Tan et al. ..... 439/620 OR
5,580,279 12/1996 Belopolsky et al. ..... 439/620 OR

*Primary Examiner*—P. Austin Bradley
*Assistant Examiner*—Daniel Wittels
*Attorney, Agent, or Firm*—Pro-Techtor International Services

[57] ABSTRACT

An interference-proof device for electric connectors including many mutually opposed conductors arranged in lines and formed on material strips, the conductors have their respectively contact portions to be integrally and respectively connected to the material strips, many connect portions in identical shape are formed on the contact portions, many interference-proof members can be mounted between the connect portions; one portion of the conductors are used for connecting to a negative pole of a circuit board, and the other portion of the conductors are used for connecting to a plurality of pins; an interference-proof device for electric connectors capable of being mass produced yet its wave filtering effect being perfect can thus be formed.

10 Claims, 9 Drawing Sheets

INTERFERENCE-PROOF DEVICE FOR ELECTRIC CONNECTOR

BACKGROUND OF THE INVENTION

1. Field of the Invention

The present invention relates to an interference-proof device for an electric connector, and especially to a wave filter mounted on a contact film which is easy to be injection molded, such device is effective in guiding a source of interference to prevent an electric system from intrusion of noises.

2. Description of the Prior Art

In advancing of techniques and sciences, various electric interferences are found in electric powers, wirelesses, fluorescent lamps, engines and computers. In the natural phenomenon such as lightning or sun light, there are also electric interferences, hence an electric connector is normally provided with an interference-proof device.

Interference preventing measures commonly used on electric connectors are alternately arranged magnetic rings used for stopping interference. The most available style of such magnetic rings is that which is directly fitted over an electric wire, as is shown in FIG. 1, a magnetic ring is fitted over an electric wire 10, its effect in eliminating noise is not desired due to inability of filtering on a plurality of core wires, besides, when it is used on an electric connector, it will be a burden to the electric connector.

Another conventional interference-proof device for an electric connector is like that shown in FIG. 2, wherein, an interference-proof ring 14 is provided between a contact portion 12 and a welded portion 13, this has the disadvantage mainly of very small spaces between the welded portions of a precesion connector used therein and therefore is undesirable for operation. FIG. 3 shows a conventional interference-proof device which is an interference-proof ring 17 provided on a PC board 15 and over two welding points, such device is only used for few members though, its effect of eliminating noise is imcomplete.

In view of the disadvantage stated above, various improved devices are provided in the recent years, however, they can not get rid of various drawback in the interference-proof devices made of magnetic powdered iron cores, when frequency is high, the magnetic powdered iron cores can not have effective interference-proofness.

SUMMARY OF THE INVENTION

Therefore, the principal object of the present invention is to provide an interference-proof device for an electric connector, wherein, a plurality of mutually opposed conductors are arranged in lines, these conductors each includes at least a pair of connection portions opposed to each other which are used to hold a wave filter therebetween, in this way, interference-proof devices can be more easily manufactured, yet the wave filtering effect can be perfect and more efficient.

The present invention will be apparent in its practical novelty and other characteristics after reading the detailed description of the preferred embodiments thereof in reference to the accompanying drawings.

DETAILED DESCRIPTION OF THE PREFERRED EMBODIMENT

Figure 1:
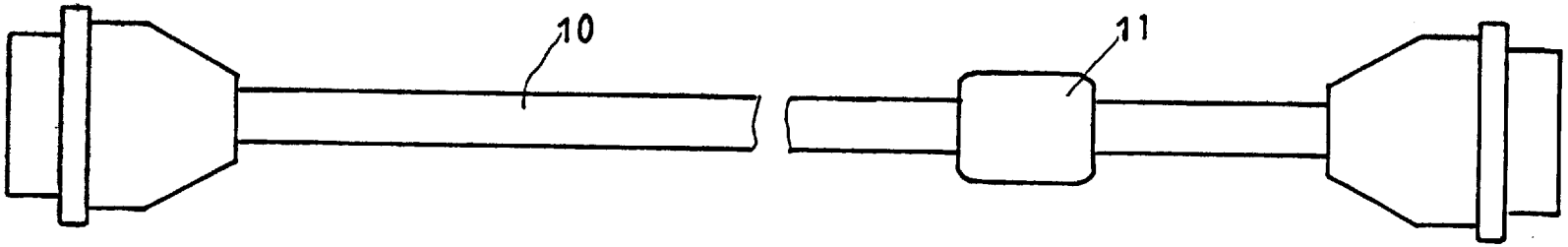
FIG. 1 PRIOR ART
FIG. 1 is a view showing the structure of a conventional interference-proof device.
Figure 2:
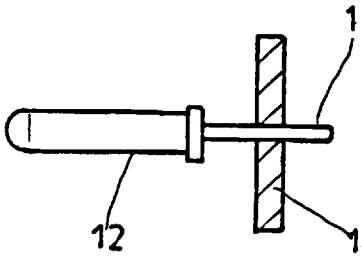
FIG. 2 PRIOR ART
FIG. 2 is a view showing the structure of another conventional interference-proof device.
Figure 3:
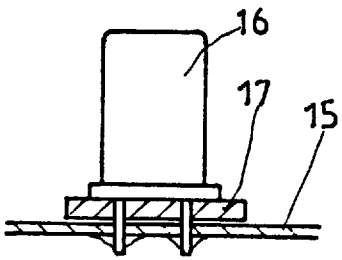
FIG. 3 PRIOR ART
FIG. 3 is a view showing the structure of a further conventional interference-proof device.
Figure 4:
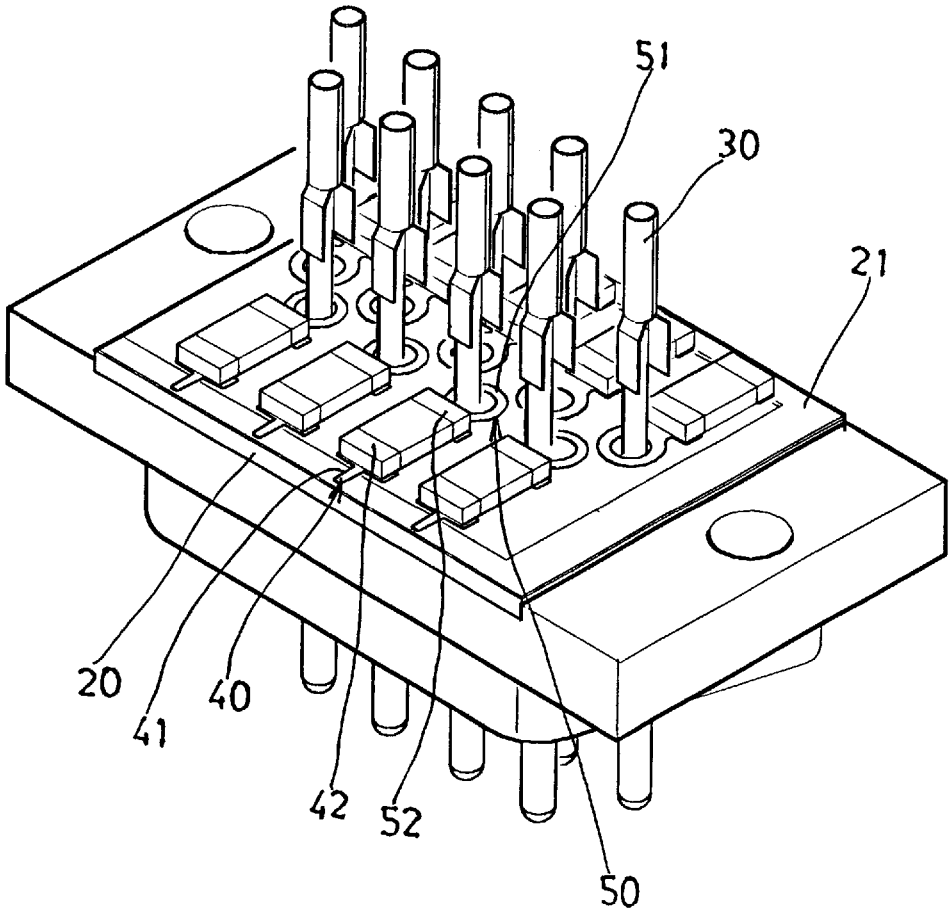
FIG. 4 is a perspective view of an embodiment of the present invention.

Referring to FIG. 4, the electric connector of the present invention shown is provided on its body with a PC board 20 having a plurality of pins 30 thereon, and is provided on the top surface thereof with a plurality of mutually opposed conductors 40, 50. On the periphery of the PC board 20 a short circuit grounding layer 21 as a negative pole is provided.

Figure 7:
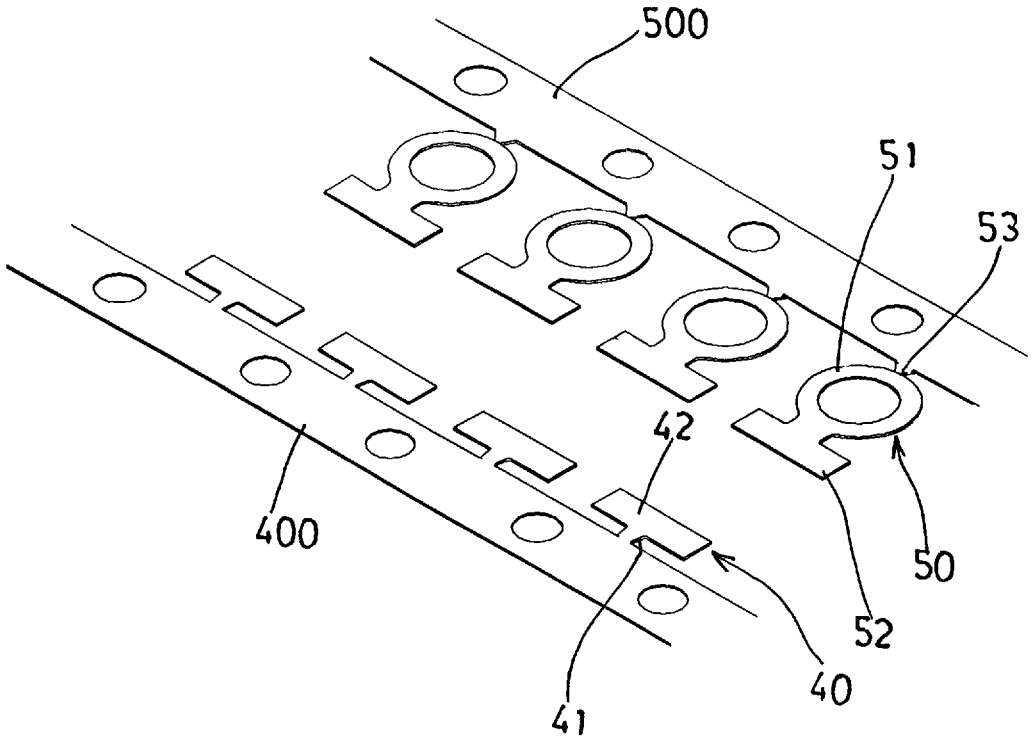
FIG. 7 is a perspective view showing the mutually opposed conductors of FIG. 4.

In FIG. 7, the conductors 40, 50 which can be punch molded from thin copper film, are formed respectively from the material strips 400, 500. In the preferred embodiment shown in the drawing, a conductor 40 includes a neck contact portion 41 and a connect portion 42 extending integrally from the neck contact portion 41. The other conductor 50 includes a ring shaped contact portion 51 and a connect portion 52 extending integrally from the ring shaped contact portion 51. In the preferred embodiment shown in the drawing, the conductor 40 is integrally connected with the material strip 400 through the neck contact portion 41, while the other conductor 50 is integrally connected with the material strips 500 through a small angle piece 53. So that the redundant material strips 400, 500 can be taken off by bending the integrally connected contact portions 41, 53 until they break away from the conductors 40, 50.

Figure 5:
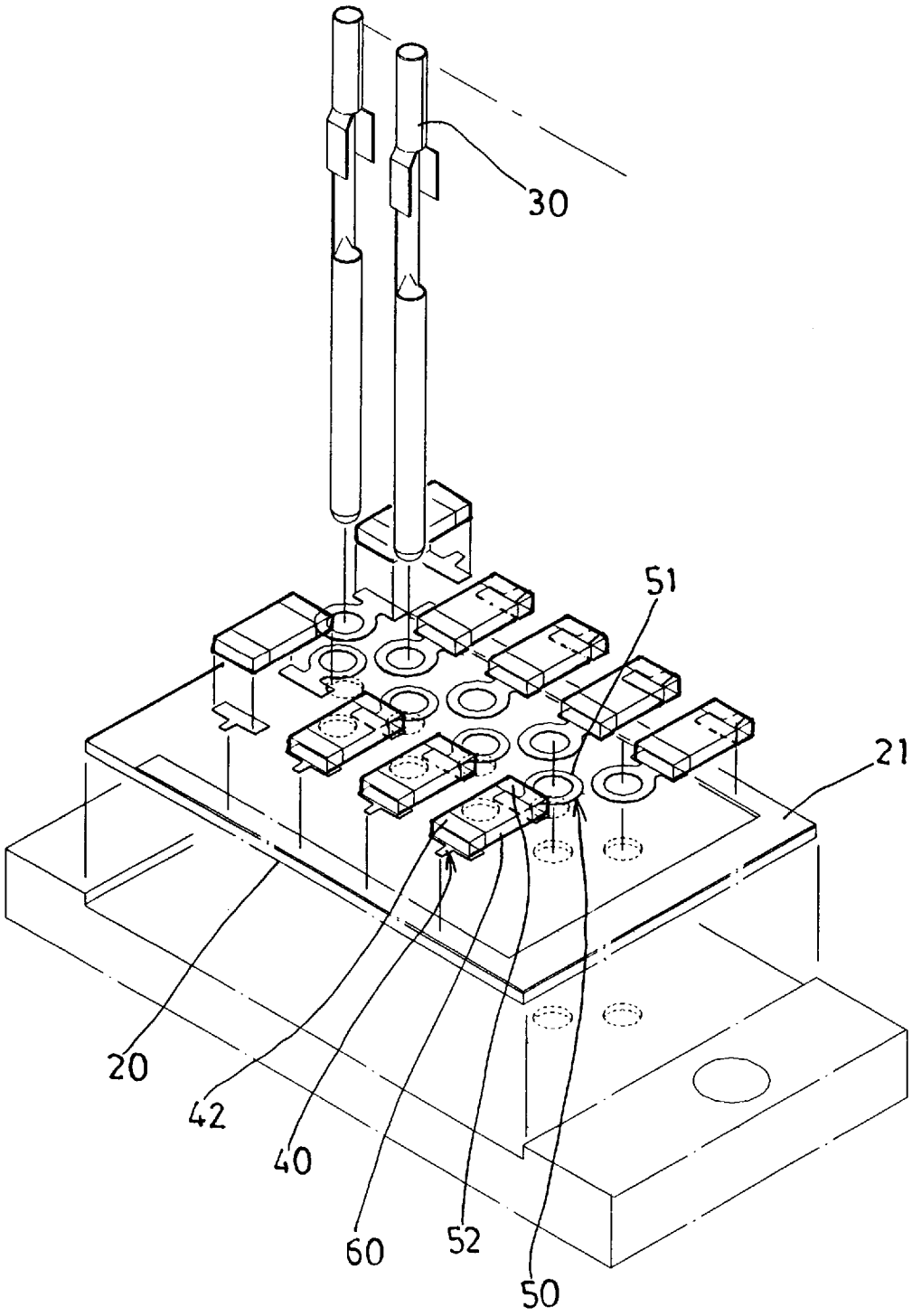
FIG. 5 is an analytical drawing showing more of the menbers of FIG. 4.
Figure 6:
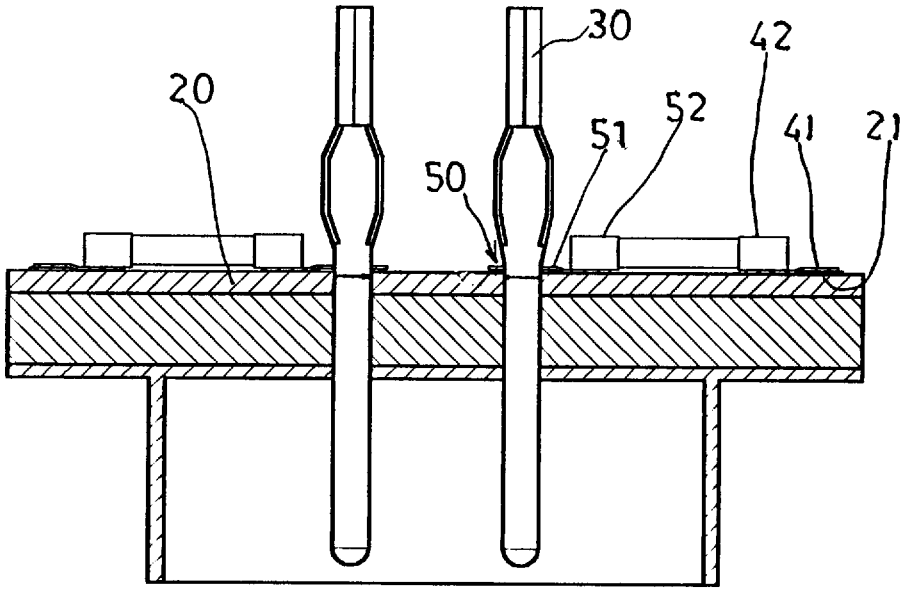
FIG. 6 is a sectional view taken from FIG. 4.

The above stated connect portions 42, 52 opposed to each other are in rectangular shapes having suitable area to be able of connecting or holding therebetween an interference-proof member 60 as are shown in FIGS. 4 to 6, such as a capacitor, a wave filter or a thunder arrester etc. It can be seen from FIGS. 4 to 6, when in assembling of the interference-proof member 60 between the conductors 40 and 50, the neck contact portion 41 of the conductor 40 is stuck to the short circuit grounding layer 21 on the PC board 20, while the ring shaped contact portion 51 of the other conductor 50 can be inserted in a pin 30, then the contact portions 41 and 51 are welded onto the PC board 20 to complete assembling.

Figure 8:
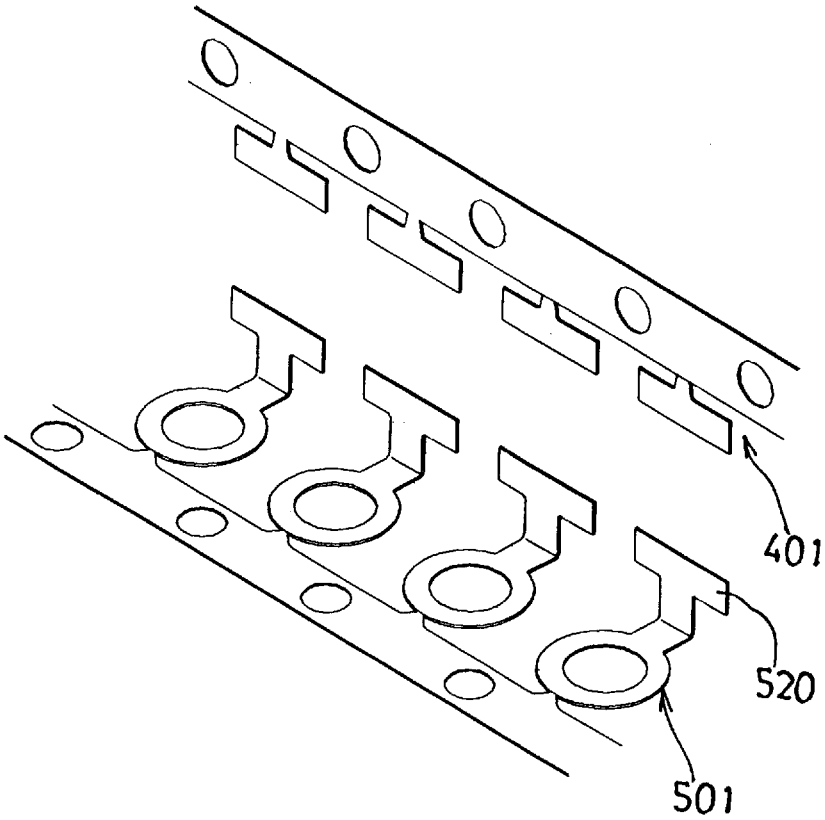
FIG. 8 shows another embodiment of conductors of the present invention.
Figure 9:
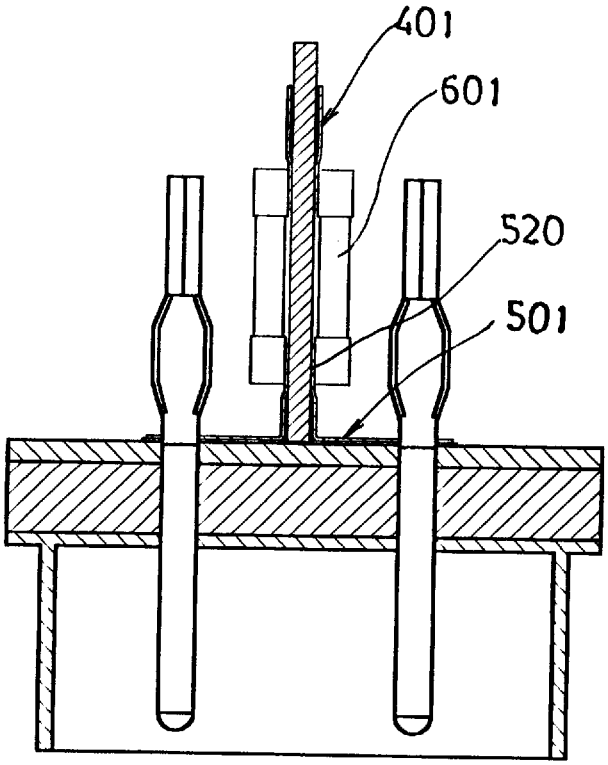
FIG. 9 is a sectional view taken from another device assembled by the mutually opposed conductors shown in FIG. 8.

In another preferred embodiment shown in FIGS. 8, 9, a conductor 501 can be bended by bending the contact portion 520 for a right angle, so that the conductors 401, 501 can be opposed to each other after bending, an upright interference-proof member 601 can be mounted therebetweeen.

Figure 10:
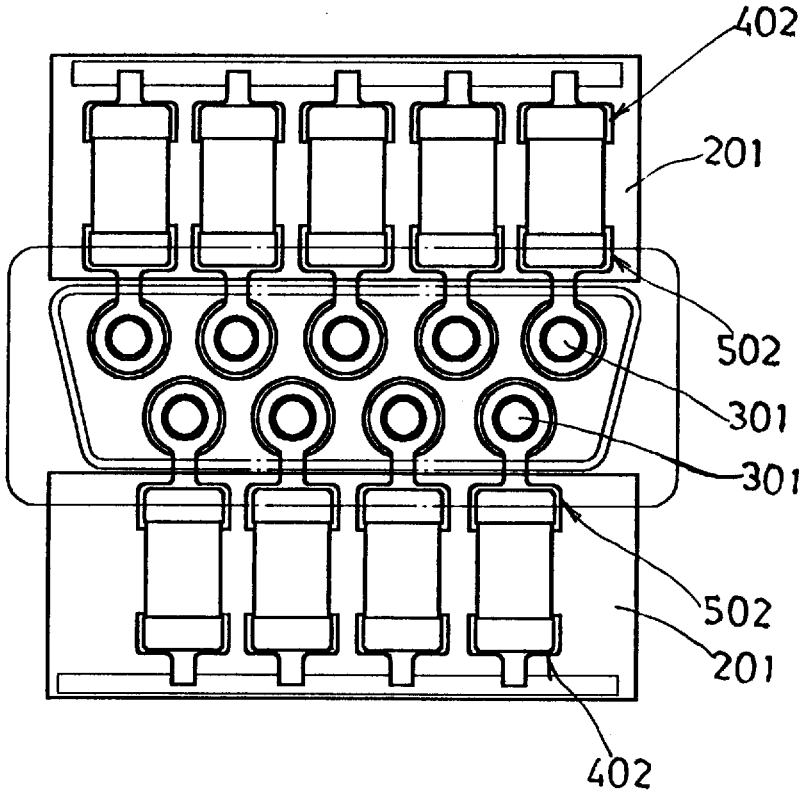
FIG. 10 is a schematic view of another embodiment of the present invention.
Figure 11:
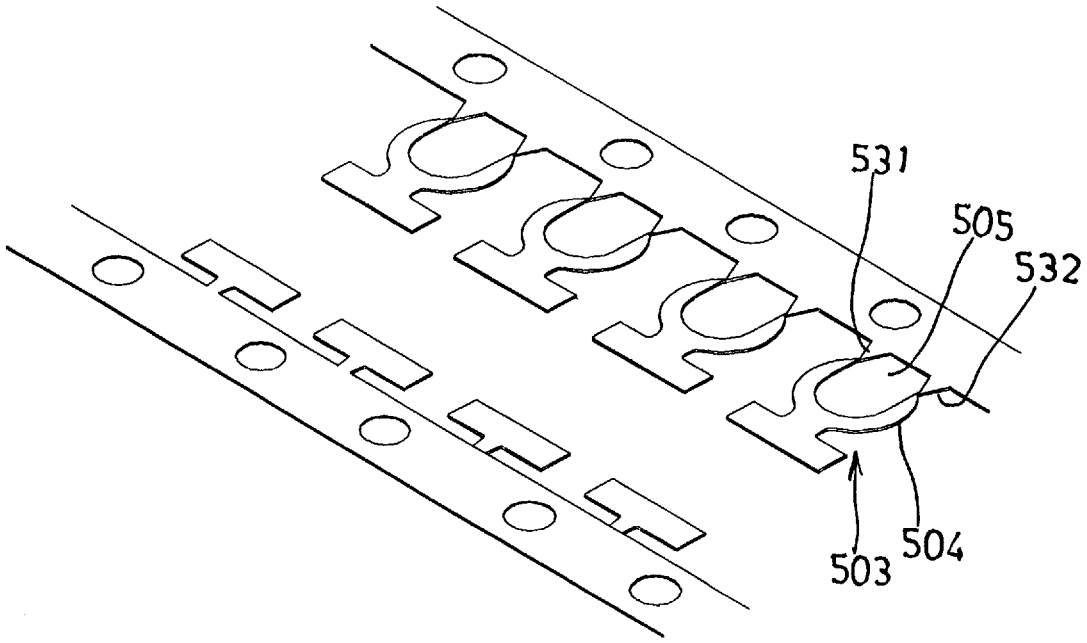
FIG. 11 shows another embodiment of mutually opposed conductors of the present invention.

In another preferred embodiment shown in FIG. 10, two sets of conductors 402 (502) in lines are provided, each conductor 502 connects one of the pins 301 also arranged in lines, the other conductors 402 are connected to two electric circuit boards 201 opposed to each other. While in another embodiment shown in FIG. 11, a contact portion 504 of a conductor 503 is formed as a fork to leave therebetween a holding space 505 to hold a pin (not shown), the contact portion 504 connect with a material strip through two angle pieces 531, 532.

The above stated improved structure of an interference-proof device for an electric connector of the present invention can be more perfect and desired due to the fact that the conductors in the whole device can all be used to hold interference-proof members, and such conductors are more feasible to be mass produced by direct punching molding, so that such interference-proof devices can be manufactured on the spot more conveniently, the whole space style thereof is brand new.

Having thus described the technical structure of my invention, what I claim as new and desire to be secured by Letters Patent of the United States is:

I claim:

1. An interference-proof device for an electric connector comprising:

a plurality of conductors arranged in at least two opposing linear arrays, said conductors being formed from electrically conductive material strips, contact portions of said conductors remain connected to said material strips following formation of said conductors, each said conductor includes a connect portion, aligned pairs of opposing connect portions receive therebetween interference-proof members; such that a first connect portion of each said aligned pair is electrically connected to a pin, and a second connect portion is electrically connected to a conducting member to be a negative pole;

said conductors being removed from said material strips during an assembly process.

2. An interference-proof device for an electric connector as stated in claim 1, wherein:

at least one of said conductors mounted with said interference-proof members are connected with an electric circuit board.

3. An interference-proof device for an electric connector as stated in claim 1, wherein:

all of said mutually opposed conductors are connected with an electric circuit board.

4. An interference-proof device for an electric connector as stated in claim 1, wherein:

said interference-proof members are capacitors.

5. An interference-proof device for an electric connector as stated in claim 1, wherein:

said interference-proof members are wave filters.

6. An interference-proof device for an electric connector as stated in claim 1, wherein:

said interference-proof members are thunder arresters.

7. An interference-proof device for an electric connector as stated in claim 1, wherein:

said connect portions on said conductors connected to said pins are capable of bending for a right angle, said conductors can be opposed to each other after bending.

8. An interference-proof device for an electric connector as stated in claim 1, wherein:

said connect portions connected to said pins are formed as forks to leave therebetween holding spaces.

9. An interference-proof device for an electric connector as stated in claim 1, wherein:

said one portion of said conductors connect integrally through a plurality of neck contact portions provided thereon while said other portion of said conductors connect integrally through a plurality of small angle pieces with said material strips.

10. An interference-proof device for an electric connector as stated in claim 1, wherein:

two set of said conductors mutually opposed to each other are provided to be connected respectively with two line of pins and two electric circuit boards mutually opposed to each other.

* * * * *